United States Patent [19]

Phillips

[11] Patent Number: 4,481,726

[45] Date of Patent: Nov. 13, 1984

[54] SHOE CONSTRUCTION

[75] Inventor: Edward H. Phillips, Middletown, Calif.

[73] Assignee: American Fitness, Inc., Sunnyvale, Calif.

[21] Appl. No.: 137,581

[22] Filed: Apr. 7, 1980

[51] Int. Cl.[3] ..... A43B 13/12

[52] U.S. Cl. ..... 36/30 A; 36/30 R

[58] Field of Search ..... 36/30 R, 30 A, 49, 44, 36/14, 126, 129, 31, 9 R

[56] References Cited

U.S. PATENT DOCUMENTS

| | | | |
|---|---|---|---|
| 672,724 | 4/1901 | Vogt | 36/14 |
| 2,311,746 | 2/1943 | Ghez et al. | 36/30 R |
| 3,416,174 | 12/1968 | Novitske | 36/9 R |
| 3,497,971 | 3/1970 | Hayashi | 36/9 R |
| 3,835,558 | 9/1974 | Revill | 36/44 |
| 4,292,746 | 10/1981 | Delaney | 36/45 |

*Primary Examiner*—Werner H. Schroeder
*Assistant Examiner*—Steven N. Meyers
*Attorney, Agent, or Firm*—Flehr, Hohbach, Test, Albritton & Herbert

[57] ABSTRACT

A shoe construction characterized by flexible layers of inelastic material sandwiching a resilient mid-sole serves to provide stability to the length and width of the sole over a trailing portion thereof.

4 Claims, 11 Drawing Figures

11a
11b
11c
31a
31b
31c
10
30
5
d

SHOE CONSTRUCTION

This invention pertains to an improved shoe construction and more particularly to an improved sole assembly for same.

In general the shoe construction disclosed herein includes a sole assembly having a compliant mid-sole of a generally compressible material such as foam or other plastic. Means for restraining the trailing portion of the mid-sole as well as permitting the leading portion thereof to flex with respect to the trailing portion includes the application of semi-stiff material above the mid-sole, either directly in contact therewith or within the shoe while a layer of substantially inelastic flexible material is glued to the bottom surface of that portion of the mid-sole which extends rearwardly to the heel end of the mid-sole from a position commencing substantially immediately behind the locus for disposing the ball of a person's foot when wearing a shoe employing the sole construction. Accordingly, the trailing portion of the mid-sole is restrained from flexing, while the leading portion can flex with respect to the trailing portion.

In general, it is an object of the present invention to provide an improved shoe sole having enhanced stability.

It is another object of the invention to provide a shoe construction with a compressible sole in which that portion extending rearwardly to the heel end thereof from a position commencing substantially immediately behind the ball of the foot is substantially inflexible in a vertical plane taken therethrough.

Yet a further object of the invention is to provide a shoe in which the upper inner surface of the toe portion of the shoe is substantially incompressible longitudinally of the shoe so as to inhibit "working" of the insole beneath the ball and toes of a foot as the forward portion of the sole flexes.

Another object of the invention is to provide a sole construction for a shoe in which a major portion of the sole is substantially inflexible both laterally and longitudinally.

It is yet a further object of the invention to provide the foregoing bi-directional inflexibility using an inner sole of cardboard or the like bonded to a layer of inelastic fabric material.

The foregoing and other objects of the invention will become more readily evident from the following detailed description of preferred embodiments when considered in conjunction with the drawings.

Figures 1, 2, 3, 4, 5, 10:
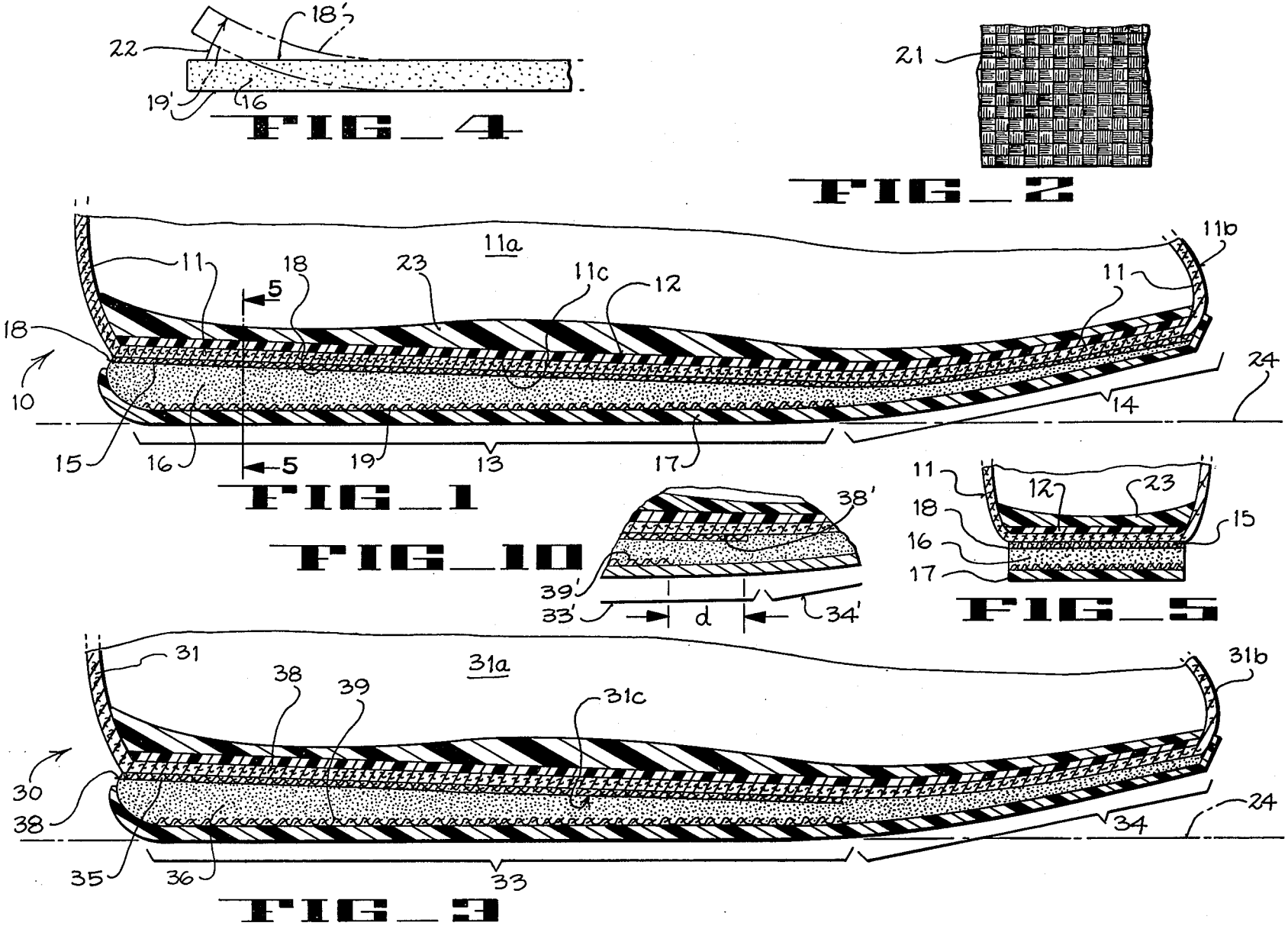
FIG. 1 shows a side elevation section view of a shoe construction according to the invention.
FIG. 2 shows a plan view in enlarged detail of a portion of a substantially inelastic flexible layer of material as described herein.
FIG. 3 shows a side elevation section view of a sole portion of a shoe according to another embodiment of the invention.
FIG. 4 shows a diagram for explanation of the function of portions of the construction.
FIG. 5 shows an elevation section view taken along the line 5—5 of FIG. 1.
FIGS. 6 through 11 show various embodiments according to the invention.

As shown in FIG. 1 a shoe construction 10 includes a shoe upper 11 having side, top and bottom portions 11*a*, 11*b*, 11*c*, respectively arranged to enclose a person's foot therein.

Thus, the bottom panel 11*c* of upper 11 is drawn about a mildly rigid liner 12 of suitable material such as fibreboard disposed upon the upper surface of bottom portion 11*c*.

Means forming a sole construction secured to the under surface of bottom portion 11*c* includes an elongated trailing section 13 substantially inflexible in a vertical plane and a forward section 14 disposed to extend in advance of trailing section 13. The trailing and forward sections 13, 14 include a mid-sole 16 common to each section. Mid-sole 16 is of compliant material such as foam rubber disposed between the underside of bottom portion 11*c* of upper 11 and the top surface of a flexible sole or tread layer 17.

Means for imparting substantial inflexibility to trailing section 13 permits the forward section 14 to flex with respect to trailing section 13. Thus, in the embodiment of FIG. 1, a fabric layer of substantially inelastic flexible material secured to the top surface of mid-sole 16 defines an interface 18 throughout the length of the top surface of mid-sole 16 and the undersurface of bottom portion 11*c*. In addition, a layer of substantially inelastic flexible fabric material is secured to define an interface 19 at the bottom surface of only the trailing section of mid-sole 16 and the top of tread layer 17. The forward end of trailing section 13 commences substantially at a position immediately behind the locus for the ball of a foot of a person who would be wearing the shoe.

FIG. 2 diagrammatically represents a swatch 21 of an inelastic fabric material of the kind employed to define the interfaces 18, 19.

Preferably, swatch 21 constitutes a polyester fabric cloth of a type for example, as manufactured by the E. I. duPont Co. and sold under the registered trademark KEVLAR, as fabric style 328, 6.8 ounces per square yard, and with 17 threads per inch in each of two perpendicular directions. The material is impregnated with a suitable polyester resin to supply a limited degree of stiffness to the material.

Accordingly, a first layer of the material 21 for forming the interface 18 is glued to the top surface of mid-sole 16 to extend substantially from heel to toe while a second layer defines the interface 19 and is glued to the bottom surface of that portion of mid-sole 16 adapted to extend rearwardly to the end of the mid-sole from a position commencing substantially immediately behind the locus for the ball of a person's foot when wearing the shoe.

Thus, by securing an inelastic fabric material to both the top and bottom of a portion of mid-sole 16, it is readily evident that any attempt to flex that portion 13 of mid-sole 16 in a vertical plane will be restrained as now to be described with respect to FIG. 4.

As used in FIG. 4, certain reference numerals employ prime marks (') to represent a corresponding portion of structure previously described.

Accordingly, any attempt to flex mid-sole 16 upwardly as shown by arrow 22 constitutes an attempt to stretch fabric 22 at interface 19 while at the same time compressing fabric 22 at interface 18. Inasmuch as fabric 21 is both incompressible and inelastic, that portion 13 of mid-sole 16 substantially bounded by the inelastic material becomes substantially inflexible, while at the same time remaining rather lightweight.

The inelastic material at interface 18 and 19 contributes largely to the stability of the shoe whereby the bottom remains flat as viewed in FIG. 5. Thus, should a person step on a rock beneath the side edge of the sole the bottom remains flat.

The continuation of the inelastic material 21 forming interface 18 along the top surface of the forward section of mid-sole 16 serves to substantially inhibit any "working" of the insole beneath the ball and toes of a foot.

Thus, it has been observed that in shoes of the general kind described herein, as a person runs in these shoes, the flexing of the forward portion causes certain frictional movement beneath the toes of the wearer which, in the present instance, is inhibited by means of the substantially incompressible material 21 whereby as the toe portion of the shoe flexes, all of the component parts are maintained in a relative position and do not move beneath the toes of the foot.

A custom made insert 23 of a type as generally disclosed, for example, in U.S. Pat. No. 4,155,180 formed of a material such as plastic foam, provides additional support to the person's foot. Insert 23 is formed to include a flat underside 26.

According to another embodiment as shown in FIG. 3, a shoe construction 30 incorporates the inelastic fabric material 21 within the bottom portion 31*c* of upper 31. Accordingly, the mid-sole 36 is captured between a pair of inelastic layers 38, 39 so as to create an inflexible trailing section 33.

Trailing sections 13 and 33 are flat so as to lie flat upon the running surface 24 while within the shoe they define a flat interior reference surface from heel to the locus of the ball of a person's foot for supporting the flat underside 26 of insert 23.

From the foregoing, it will be readily evident that there has been provided an improved shoe of a type having a flexing forward portion and a substantially inflexible trailing portion so as to provide a relatively stabilized shoe. In addition, the "working" of the inner sole of the shoe is inhibited by the means described so as to reduce the degree of friction generated inside the shoe beneath the toe portion of a person's foot.

Figure 6:
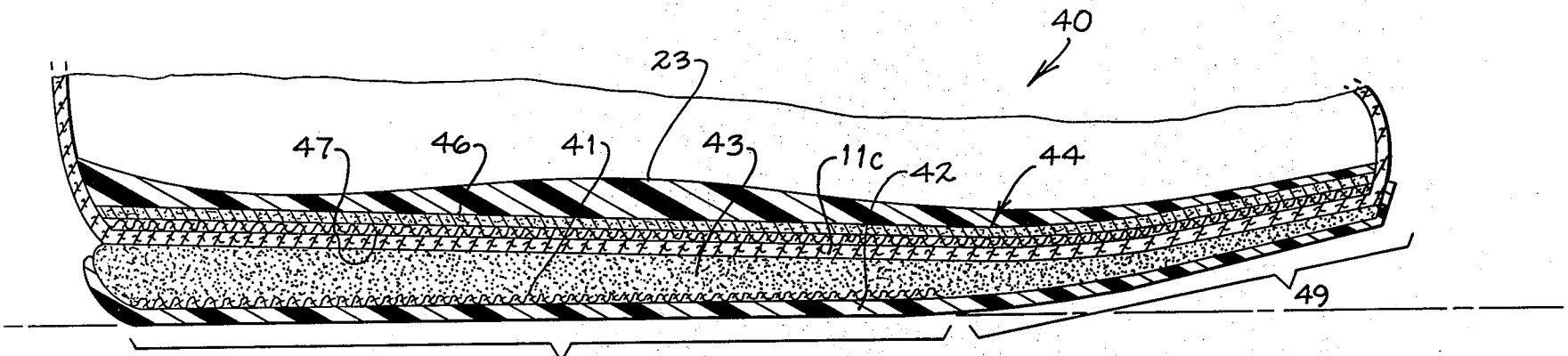

According to another embodiment 40 as shown in FIG. 6 an inelastic layer 41 of fabric defines an interface between the sole or tread portion 42 and mid-sole 43 as described above. However, an innersole 44 comprising a layer of cardboard 46 and a layer of inelastic flexible fabric material 47 of the kind noted are bonded together to provide an upper layer of stiffness capturing the trailing portion of the mid-sole 43 so as to provide a flat, relatively stiff trailing section 48 to the sole while the forward section 49 can flex with respect thereto.

Figure 7:
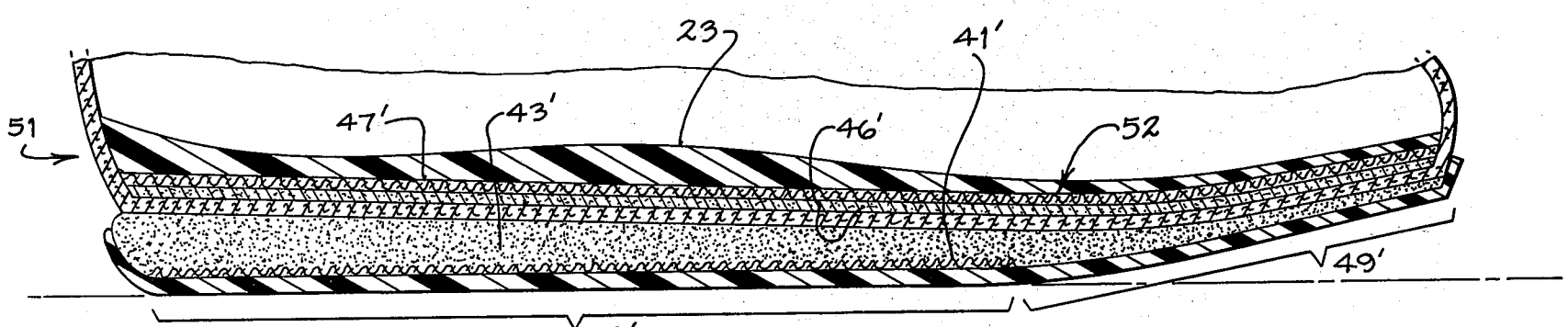

Similarly, as shown in the embodiment 51 of FIG. 7 a corresponding arrangement is provided wherein the innersole 52 corresponds to innersole 44 of embodiment 41 but is inverted whereby the inelastic fabric lies on top and the cardboard, bonded thereto, lies beneath.

Accordingly, as shown in FIG. 7, the reference numerals 46' and 47' respectively correspond to cardboard and fabric layers which are bonded together as described with regard to embodiment 40 to provide an innersole 52 which is inverted with respect thereto.

Similarly, an inelastic layer 41' of fabric is employed in embodiment 51 in a manner as described above.

As thus arranged embodiment 51 provides a mid-sole which is substantially inflexible throughout a trailing portion thereof while at the same time remaining compressible due to the nature of mid-sole 43'.

Figures 8, 9, 11:
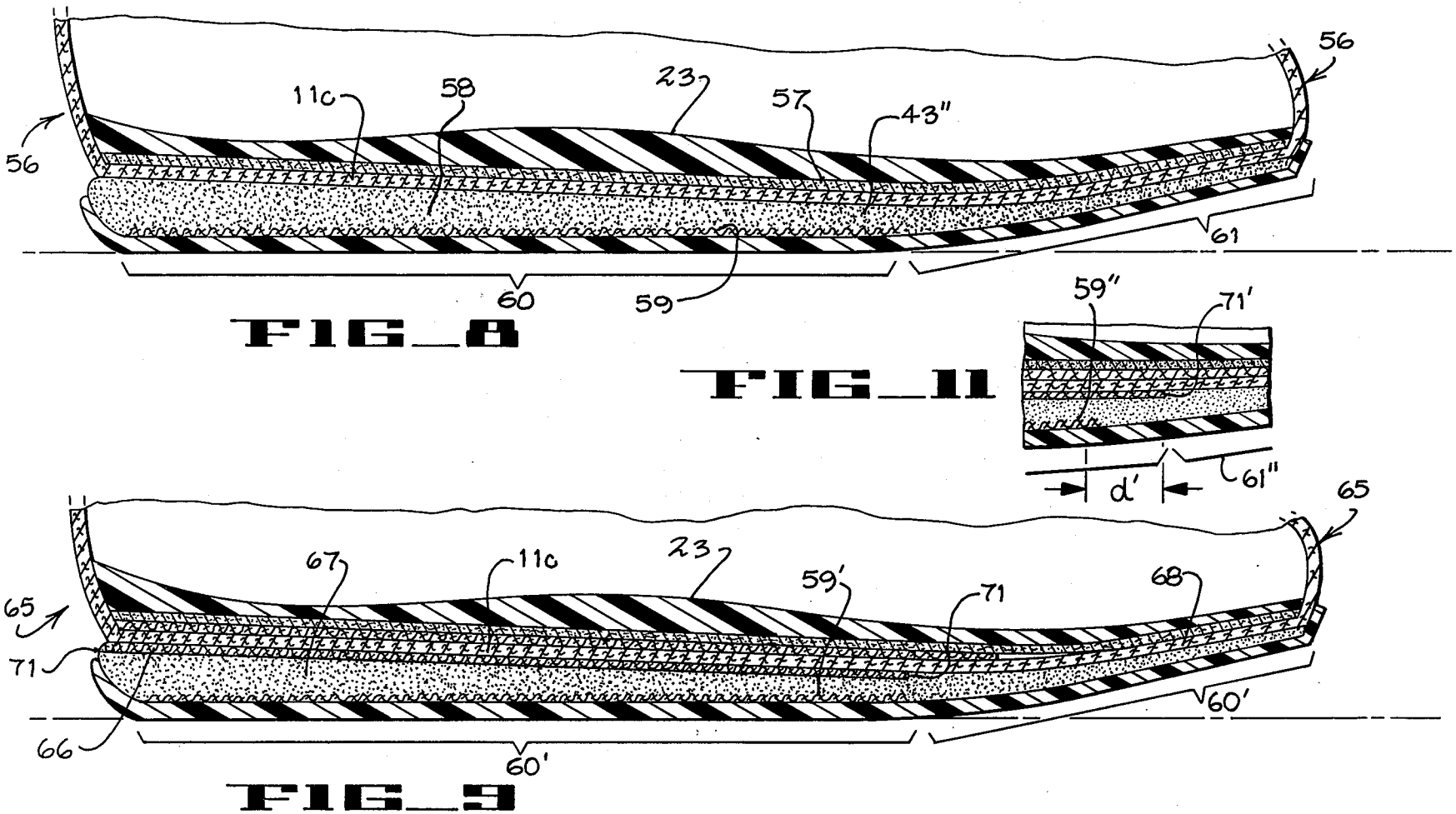

The embodiment 56 shown in FIG. 8 serves to accomplish substantially the same objectives as the embodiments heretofore described with substantial simplicity. Accordingly, an innersole of relatively stiff material such as cardboard 57 provides stiffness to the top side of mid-sole 58 while the inelastic fabric layer 59 glued to the underside of mid-sole 58 serves to form a wedgelike portion to mid-sole 58 which is substantially incapable of being flexed in any direction. However, the forward section 61 of embodiment 56 is free to flex with respect to the trailing portion 60 of midsole 58.

According to the embodiment 65 of FIG. 9, the embodiment of FIG. 8 has been reinforced by the provision of an additional strengthening layer 66 of inelastic flexible fabric material disposed between mid-sole 67 and the bottom surface of upper 68 so as to form a wedge shaped portion of mid-sole 67 defined between the inelastic layer 59' and 66.

As shown in FIGS. 1, 3 and 9 means such as glue forms an interface connection 18, 38, 71 between layer 15, 35, 66 of inelastic material and the mid-sole 16, 36, 67, while in FIGS. 6–8 the fact that the bottom portion 11*c* of the upper is glued to the top of mid-sole 43, 43', 43'' while the innersole 44, 52 and 57 are glued to the upper surface of portion 11*c* serves to form the connection between the top of mid-sole 43, 43', 43'' and the inelastic layer 47, 47', 57 thereabove.

According to the embodiment shown in FIG. 3 the layers of KEVLAR 38, 39 terminate in substantially the same vertical plane. It has been observed, however, as shown in the detail view of FIG. 10 that by terminating layer 39' short of the end of layer 38' so as to provide a displacement "d" longitudinally between their ends, the sole construction will provide improved wear characteristics. FIG. 10 is considered to be a detail of a portion to be substituted into the embodiment shown in FIG. 3 taken in the region bounded by the line 10—10.

Similarly, as shown in the embodiment of FIG. 11, when considered in conjunction with the embodiment shown in FIG. 9, an improved wear characteristic can be provided to the sole construction of FIG. 9 by extending layer 71' beyond the end of layer 59''.

It has been observed that by having the layer 39' commence at a position rearwardly of the leading end of layer 38' that the sole assembly will provide additional strength and control of flexing at the ball area as well as reducing the wear referred to above. Similarly the embodiment referred to in FIG. 10 has been observed to have the same improved characteristics.

I claim:

1. In a shoe construction including a shoe upper having side, top and bottom portions arranged to enclose a person's foot therein, a mildly rigid liner disposed upon the top of said bottom portion within said upper, and a sole construction secured to the undersurface of said bottom portion, said sole construction comprising an elongate trailing section and a forward section disposed to extend in advance of said trailing section, said trailing and forward sections including a mid-sole of compliant material, and means for imparting substantial inflexibility to said trailing section in a vertical plane while permitting said forward section to flex with respect to said trailing section.

2. In a shoe construction according to claim 1 wherein the last named means comprises a layer of substantially inelastic flexible material secured to the top surface of the substantially combined length of said trailing and forward sections and a layer of substantially inelastic flexible material secured to the bottom surface of said trailing section to the exclusion of said forward section.

3. In a shoe construction including a shoe upper having side, top and bottom portions, and a sole construction secured to the bottom portion, said sole construction comprising an elongate trailing section and a forward section disposed to extend in advance of said trailing section, said sections including a mid-sole of compliant material, a layer of substantially inelastic flexible fabric defining an interface between said bottom portion and said mid-sole for the substantially combined length of said trailing and forward sections, and a layer of substantially inelastic flexible fabric secured to the bottom surface of said trailing section to the exclusion of the forward section to impart substantial rigidity to said trailing section.

4. In a shoe construction having a portion of an upper to be disposed beneath a person's foot, a sole assembly comprising a resiliant mid-sole, a first substantially inelastic layer of material disposed beneath and secured to that portion of said mid-sole which extends rearwardly to the heel end of said mid-sole from a position commencing substantially immediately behind the locus for disposing the ball of a person's foot within the shoe to the exclusion of that portion of said mid-sole extending forwardly of said locus to the toe end of said mid-sole, a second substantially inelastic layer of material disposed above said mid-sole and means forming a connection between said second layer and said mid-sole, said first and second layers serving to capture a portion of said mid-sole therebetween to minimize flexing thereof in a vertical plane taken through said mid-sole, said second layer extending beyond the forward end of said first layer to provide improved wear.

* * * * *